US007343633B2

(12) United States Patent
Lo

(10) Patent No.: US 7,343,633 B2
(45) Date of Patent: Mar. 18, 2008

(54) TRANSMISSION MECHANISM

(75) Inventor: Ching-Chieh Lo, Shulin (TW)

(73) Assignee: Dong Yi Plastic Co., Ltd., Taipei County (TW)

( * ) Notice: Subject to any disclaimer, the term of this patent is extended or adjusted under 35 U.S.C. 154(b) by 257 days.

(21) Appl. No.: 11/291,873

(22) Filed: Dec. 2, 2005

(65) Prior Publication Data

US 2006/0117474 A1 Jun. 8, 2006

(30) Foreign Application Priority Data

Dec. 3, 2004 (TW) ..... 93219567 U

(51) Int. Cl.
*A47K 13/10* (2006.01)

(52) U.S. Cl. ..... 4/246.1

(58) Field of Classification Search ..... 4/246.1

See application file for complete search history.

(56) References Cited

U.S. PATENT DOCUMENTS 4,995,120 A * 2/1991 Tager ..... 4/246.1
7,150,049 B1 * 12/2006 Fitch ..... 4/246.1

* cited by examiner

*Primary Examiner*—Robert M. Fetsuga
(74) *Attorney, Agent, or Firm*—Troxell Law Office, PLLC

(57) ABSTRACT

A transmission mechanism comprises a rotating shaft, a main column, a rotating column, a stick, a spring and a fixed column. The main column has a first axle hole receiving the rotating shaft. End of the main column has an O-shaped trench having a stop within. The rotating column fixed with the rotating shaft has a through hole between its first end and second end. The stick is plugged into the through hole. The fixed column fixed with the toilet has a third axle hole receiving the rotating shaft. The fixed column has a C-shaped trench having a deep first terminal and a shallow second terminal. The spring is disposed to enclose the stick and is for elastically protruding the stick out the first end or the second end to insert the C-shaped trench or the O-shaped trench.

5 Claims, 3 Drawing Sheets

TRANSMISSION MECHANISM

BACKGROUND OF THE INVENTION (1) Field of the Invention

The present invention generally relates to a toilet, and more particularly to a transmission mechanism for lifting a toilet seat automatically.

(2) Description of the Prior Art

Toilet is an essential equipment for people today. Under the tendency of automation, several prior arts about lifting the toilet seat automatically by utilizing a motor had appeared in the market.

Please refer to FIG. 1, it shows a prior toilet 2, which comprises a motor 12 for automatically lifting. The toilet 2 includes a toilet seat 4 and a main body 6. The toilet seat 4 has a pipe structure 8 at one end. The pipe structure 8 has a hole for receiving a rotating shaft 10. Besides, the rotating shaft 10 is fixed with the pipe structure 8. One end of the rotating shaft 10 is driven by the motor 12. Hence, the toilet 2 is capable of automatically rotating up or down by the rotating shaft 10 utilizing the force generated by the motor 12.

However, there are several problems with the prior toilet 2: 1) The rotating speed of the toilet seat 4 is usually limited, that is, it usually being lifted slowly, no matter up or down. The motor 12 employed in this kind of product often provides limited rotating angular velocity under the product safety concern. While an user really need to go to the washroom, the limited rotating speed often drives man crazy. 2) If the electric power is cut during toilet seat 4 being lifted, the toilet seat 4 would be locked at a specific angle, because of the stopped motor 12. In this situation, the toilet 2 is unable to be used. 3) The motor 12 may provide an excessive rotating force to break the transmission mechanism within or the motor 12 itself. This could be resulted from instable electricity. Therefore, the prior toilet 2 also has a product life time issue.

In view of the foregoing problems, a toilet, which comprises a automatically rotating toilet seat and without foregoing problems, is therefore needed.

SUMMARY OF THE INVENTION

An objective of the present invention is to provide a transmission mechanism, which is capable of automatically lifting a toilet seat, Another objective of the present invention is to provide a automatically rotating toilet seat, which is able to be lifted up or down by a user.

Another objective of the present invention is to provide a transmission mechanism, which is capable of rotating a toilet seat even if the electric power is cut.

Another objective of the present invention is to provide a automatically rotating toilet seat, which has an extending product life time.

The provided transmission mechanism for lifting a toilet seat automatically on a toilet by a motor comprises a rotating shaft, a main column, at least one rotating column, at least one stick, at least one spring and at least one fixed column. The rotating shaft is driven by the motor. The main column has a first axle hole for receiving the rotating shaft. The toilet seat is connected outside with the main column. At least one end of the main column has an O-shaped trench. A stop is disposed within the O-shaped trench.

The rotating column has a second axle hole for receiving and fixing with the rotating shaft. The rotating column has a first end and a second end and at least one through hole between the first end and the second end. The first end is adjacent to the main column. The through hole is divided into a thin hole near the first end and a thick hole near the second end. The stick comprises a thick stick and a thin stick. The stick is plugged into the through hole. The spring is disposed in the thick hole and encloses the thin stick. A radius of the thin hole is smaller than the spring and the thick stick. The fixed column is fixed with a main body of the toilet. The fixed column has a third axle hole disposed at its axle center for receiving the rotating shaft. The second end of the rotating column is adjacent to the fixed column. The fixed column has a C-shaped trench for receiving the thick stick. The C-shaped trench has a first terminal and a second terminal. Deepness of the C-shaped trench becomes shallower from the first terminal to the second terminal.

These and other objectives of the present invention will no doubt become obvious to those of ordinary skill in the art after reading the following detailed description of the preferred embodiment which is illustrated in the various figures and drawings.

BRIEF DESCRIPTION OF THE DRAWINGS

The present invention will now be specified with reference to its preferred embodiment illustrated in the drawings, in which.

DESCRIPTION OF THE PREFERRED EMBODIMENT

Figure 1:
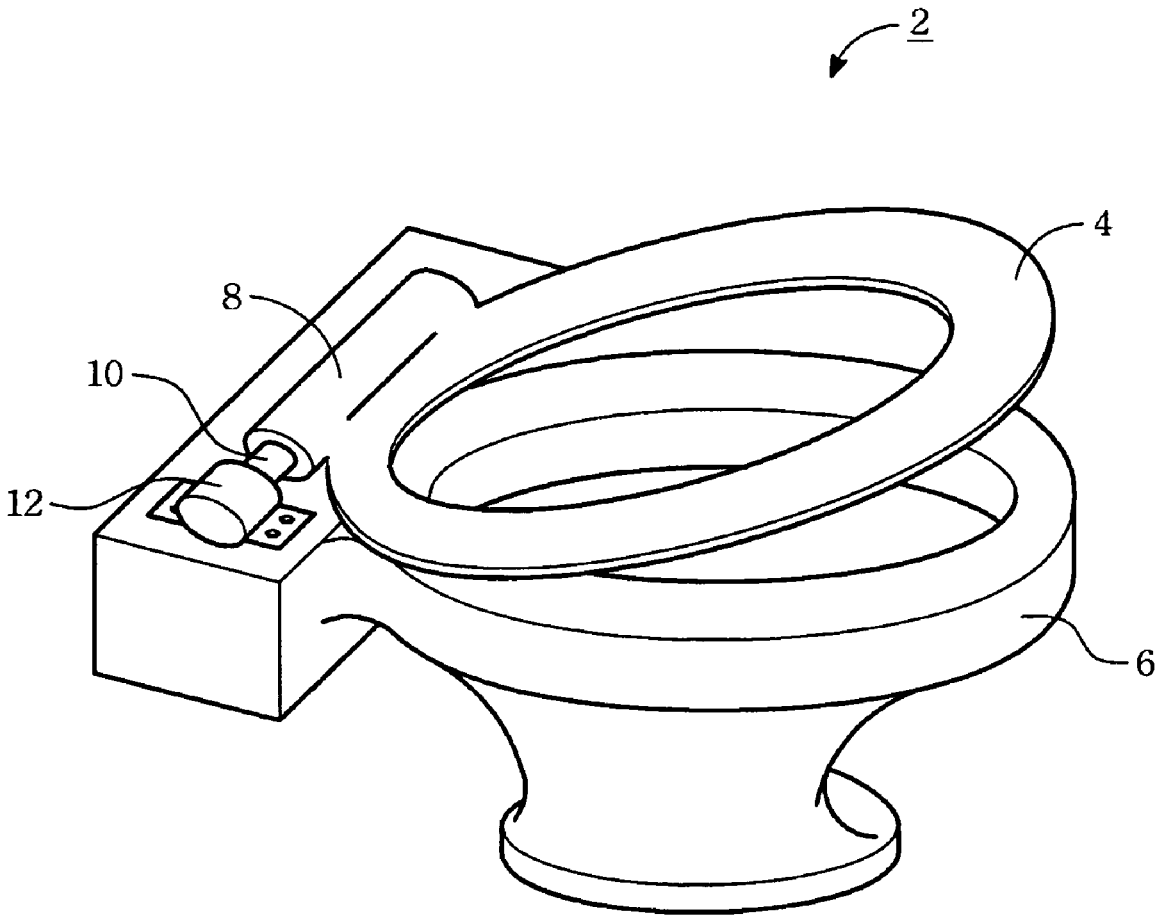
FIG. 1 (Prior Art)
FIG. 1 shows a prior toilet which comprises a motor for automatically lifting a toilet seat.
Figure 2:
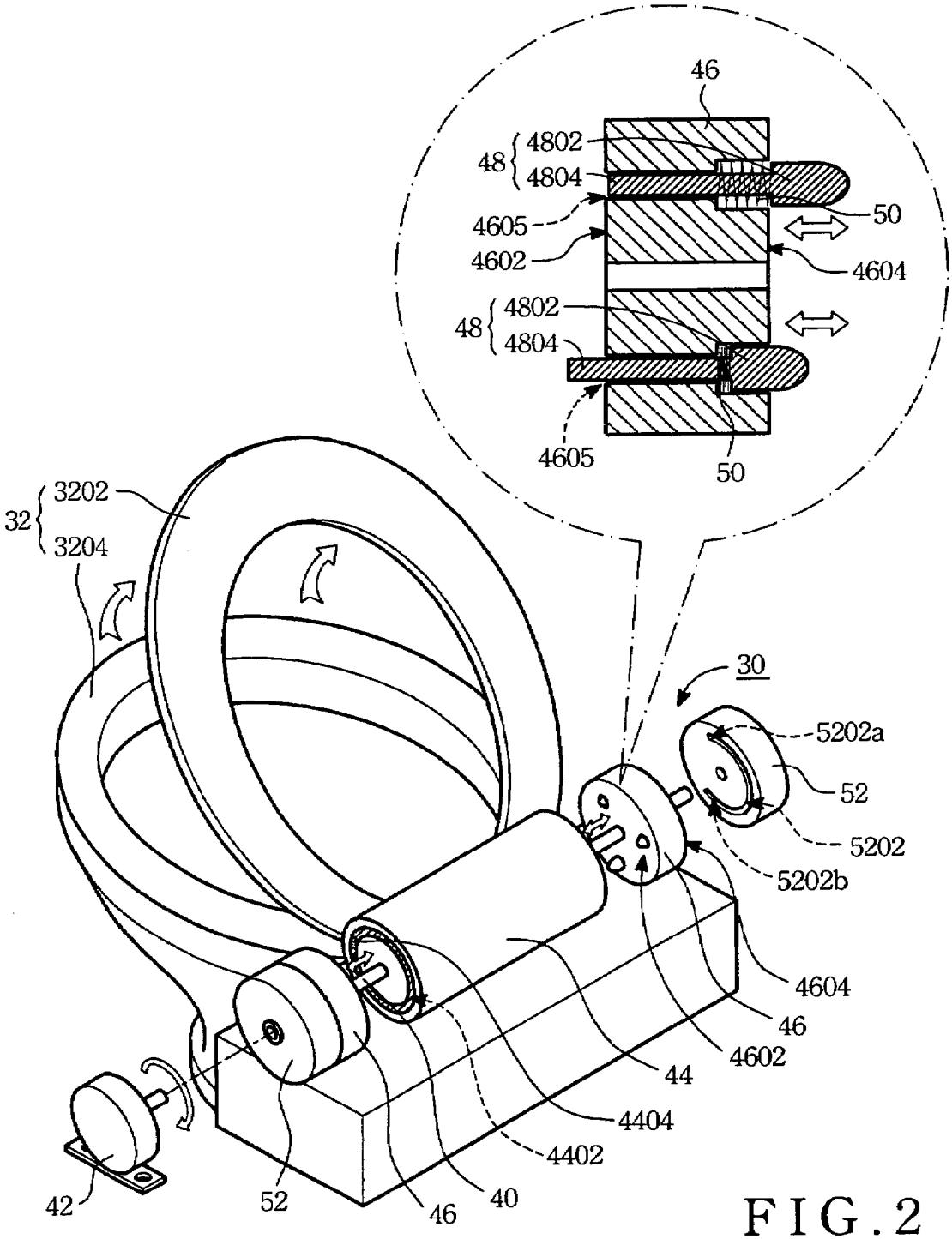
FIG. 2 illustrates a toilet and a transmission mechanism according to the present invention.

Please refer to FIG. 2, it illustrates a transmission mechanism 30 according to the present invention. A toilet 32 comprises a toilet seat 3202 and a main body 3204.

The transmission mechanism 30 provides a first force, which is provided by a motor 42, to lift the toilet seat 3202 to a first position. The first position means a predetermined position where the toilet seat 3202 is opened completely. A second force, which is provided by an user, is applied to lifting down the toilet seat 3202 to a second position. The second position means a predetermined position where the toilet seat 3202 is closed completely. In other words, the present invention provides a transmission mechanism 30 capable of automatically lifting the toilet seat 3202 up.

The transmission mechanism 30 comprises a rotating shaft 40, a main column 44, at least one rotating column 46, at least one stick 48 and at least one fixed column 52. Mentioned main column, rotating column 46 and fixed column 52 respectively joints with the rotating shaft 40 by their axle centers. In a preferred embodiments shown as FIG. 2, two rotating columns 46 are disposed at two ends of the main column individually; and two fixed column are disposed outside these two rotating columns 46 individually. As to the stick 48, in practice, the amount of the stick 48 can be arranged. For example, the amount of the stick 48 ranges from one to four are all the achieved embodiments of the present invention.

In one embodiment, the motor 42 is a synchronous motor. The rotating shaft 40 is driven by the motor 42 which provides the mentioned first force.

The main column 44 has a first axle hole disposed at its axle center for receiving the rotating shaft 40. But the rotating shaft 40 is not fixed with the main columns 44. The toilet seat 3202 is connected outside with the main column 44. Two ends of the main column 44 respectively has an O-shaped trench 4402. A stop 4404 is disposed within the O-shaped trench 4402.

The rotating column 46 has a second axle hole disposed at its axle center for receiving the rotating shaft 40. Besides, the rotating column 46 is fixed with the rotating shaft 40. The rotating column 46 has at least one through hole 4605 between a first end 4602 and a second end 4604. The through hole 4605 is substantially parallel to the second axle hole of the rotating column 46. After fabrication, the first end 4602 is adjacent to the main column 44.

The stick 48 comprises a thick stick 4802 and a thin stick 4804. A spring 50 is disposed to enclose the thin stick 4804. The through hole 4605 is divided into a thick hole and a thin hole. The thick hole is near to the second end 4604 for receiving the thick stick 4802, and the thin hole is near to the first end 4602 for receiving the thin stick 4804. During fabrication, the thin stick 4804 is plugged into the through hole 4605 through a direction from the second end 4604 to the second end 4602. A radius of the thin hole is smaller than the spring 50 and the thick stick 4802. Therefore, even if a force is applied on the stick 48 through the direction from the second end 4604 to the first end 4602, the spring 50 and the thick stick 4802 can only stop in the thick hole, but not enter into the thin hole. In this pressed situation, the thin stick 4804 protrudes out the first end 4602.

The fixed column 52 is fixed with the main body 3204 of the toilet 32. The fixed column 52 has a third axle hole disposed at its axle center for receiving the rotating shaft 40. After fabrication, the second end 4604 of the rotating column 46 is adjacent to the fixed column 52. The fixed column 52 has a C-shaped trench 5202 disposed on one of its end, which is adjacent to the second end 4604 of the rotating columns 46. This C-shaped trench 5202 is capable of receiving the thick stick 4802.

The C-shaped trench 5202 has a first terminal 5202*a* and a second terminal 5202*b*. The deepness of the C-shaped trench 5202 is not a same value at each portion. The first terminal 5202*a* has a deepest deepness. The second terminal 5202*b* has a shallowest deepness. The deepness changes continuously from the first terminal 5202*a* to the second terminal 5202*b* .

While the motor 42 provides mentioned first force, the rotating shaft 40 and the rotating column 46 is rotated in a direction corresponding to lifting the toilet seat 3202 up. The thick stick 4802 slides in the C-shaped trench 5202 in a direction from the first terminal 5202*a* to the second terminal 5202*b*. What is deserved to be mentioned here is that the C-shaped trench 5202 or the fixed column 52 will not be rotated by the rotating shaft 40. Hence, while the stick 48 is pressed by the fixed column 52 and protruding its thin stick 4804 out of the first end 4602 of the rotating column 46, the thin stick 4804 inserts into the O-shaped trench 4402 of the main column 44. While the thin stick 4804 sliding in the O-shaped trench 4402 reaches the stop 4404, the main column 4404 is able to be rotated. And the toilet seat 3202 is lifted.

While the toilet seat 3202 is lifted to the mentioned first position, where a predetermined position that the toilet seat 3202 is opened completely, the stop 4404 is in a predetermined location substantially right against the first terminal 5202*a*. Here, the stick 48, which pushes the main column 44 rotating, will insert its thick stick 4802 into the first terminal 5202*a* of the C-shaped trench 52 and releases the main column 44. By these, the whole transmission mechanism 30 or the motor 42 is able to be protected from over rotation.

Figure 3:
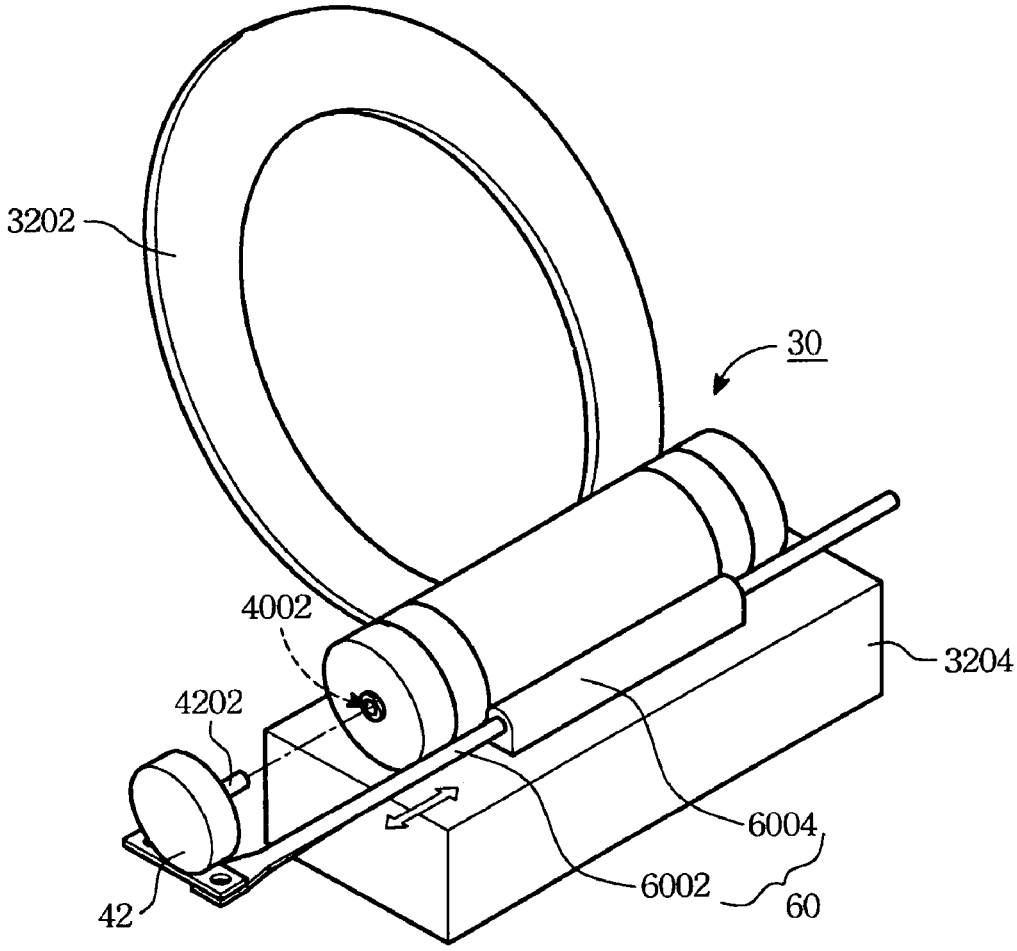
FIG. 3 illustrates a transmission mechanism according to another embodiment of the present invention.

Please refer to FIG. 3, it illustrates a transmission mechanism 30 according to another embodiment. The transmission mechanism 30 of the present invention further comprises a rejecting mechanism 60. The rejecting mechanism 60 includes a rejecting shaft 6002 and a sleeve 6004, correspondingly. The sleeve 6004 is fixed with the main body 3204 of the toilet 32 and receives the rejecting shaft 6002 thereof. One end of the rejecting shaft 6002 is fixed with the motor 42.

The motor 42 comprises a motor spindle 4202. The rotating shaft 40 has a spindle bore 4002 for receiving and engaging with the motor spindle 4202. In practice, the cross section of the spindle bore 4002 and the motor spindle 4202 is able to be selected from the shapes of triangle, quadrangle or other polygons.

While the electric power is cut, for example, a user can use the rejecting shaft 6002 to remove the motor spindle 4202 from the spindle bore 4002, so as to separate the motor 42 and the rotating shaft 40. Thus, elements as rotating shaft 40, main column 44, rotating column 46, fixed column 52 are separated from the motor 42. The toilet seat 3202 is able to be lifted up or down freely by the user.

Accordingly, the present invention has provided a transmission mechanism, which is capable of automatically lifting a toilet seat. In the other hand, an automatically rotating toilet seat employed the present transmission mechanism is able to be lifted up or down by an user and will not be broken by this external force from the user. The motor, which drives the transmission mechanism, will not be broken by this external force, either. Even if the electric power is cut, the present transmission mechanism is able to be separated from the motor, so as to ensure the toilet is able to be used at this kind of situation. By the present invention, the product life time of the automatically rotating toilet seat is extended.

With the example and explanations above, the features and spirits of the invention are hopefully well described. Those skilled in the art will readily observe that numerous modifications and alterations of the device may be made while retaining the teaching of the invention. Accordingly, the above disclosure should be construed as limited only by the metes and bounds of the appended claims.

I claim:

1. A transmission mechanism for lifting a toilet seat automatically on a toilet by a motor, comprising:

a rotating shaft, driven by the motor;

a main column, having a first axle hole for receiving the rotating shaft, the toilet seat connected outside with the main column, wherein at least one end of the main column has an O-shaped trench, a stop disposed within the O-shaped trench;

at least one rotating column, having a second axle hole for receiving and fixing with the rotating shaft, the rotating column having a first end and a second end and at least one through hole between the first end and the second end, wherein the first end is adjacent to the main column, wherein the through hole is divided into a thin hole near the first end and a thick hole near the second end;

at least one stick, comprising a thick stick and a thin stick, the stick plugged into the through hole;

at least one spring, disposed in said thick hole and enclosing the thin stick, wherein a radius of the thin hole is smaller than the spring and the thick stick; and at least one fixed column, fixed with a main body of the toilet, the fixed column having a third axle hole disposed at its axle center for receiving the rotating shaft, the second end of the rotating column being adjacent to the fixed column, wherein the fixed column has a C-shaped trench for receiving the thick stick, the C-shaped trench having a first terminal and a second terminal, deepness of the C-shaped trench becoming shallower from the first terminal to the second terminal.

2. The transmission mechanism according to claim 1, wherein the amount of said stick of one said rotating column is selected from one, two, three or four.

3. The transmission mechanism according to claim 1, wherein the motor is a synchronous motor.

4. The transmission mechanism according to claim 1 further comprises a rejecting mechanism including:

a rejecting shaft, one end of the rejecting shaft fixed with the motor; and a sleeve, fixed with the main body and receiving the rejecting shaft.

5. The transmission mechanism according to claim 1, wherein the motor has a motor spindle, the rotating shaft has a spindle bore for receiving and engaging with the motor spindle.

* * * * *